United States Patent [19]

Swanson

[11] 4,211,416

[45] Jul. 8, 1980

[54] GOLF CLUB

[76] Inventor: Arthur P. Swanson, 1454 Estate La., Glenview, Ill. 60025

[21] Appl. No.: 962,880

[22] Filed: Nov. 22, 1978

[51] Int. Cl.[2] ..... A63B 53/04

[52] U.S. Cl. ..... 273/164

[58] Field of Search ..... 273/77 R, 80 C, 164, 273/167–175, 183 D

[56] References Cited

U.S. PATENT DOCUMENTS

| | | | |
|---|---|---|---|
| D. 207,227 | 3/1967 | Solheim | 273/167 D X |
| D. 208,984 | 10/1967 | Huelsman et al. | 273/167 D X |
| 786,268 | 4/1905 | Corey et al. | 273/164 X |
| 1,525,148 | 2/1925 | Pickop | 273/167 G |
| 1,550,501 | 8/1925 | Byrne | 273/167 G |
| 2,088,095 | 7/1937 | Sargent et al. | 273/80 C |
| 2,174,212 | 9/1939 | Newsome | 273/77 R |
| 2,683,036 | 7/1954 | Klein | 273/80 C |
| 3,077,350 | 2/1963 | Koorland | 273/164 |
| 3,088,736 | 5/1963 | Mospan | 273/167 G X |
| 3,360,268 | 12/1967 | Molinari | 273/169X |
| 3,595,582 | 7/1971 | Chapman | 273/164 X |
| 3,858,886 | 1/1975 | Cosby | 273/167 F |
| 3,923,308 | 12/1975 | Mills | 273/167 G X |
| 3,947,041 | 3/1976 | Barber | 273/167 G |
| 3,981,507 | 9/1976 | Nunziato | 273/164 |
| 3,995,864 | 12/1976 | Cochran et al. | 273/164 |
| 4,128,244 | 12/1978 | Duclos | 273/164 |

FOREIGN PATENT DOCUMENTS

| | | | |
|---|---|---|---|
| 1232651 | 5/1971 | United Kingdom | 273/80 C |

*Primary Examiner*—Richard J. Apley

*Attorney, Agent, or Firm*—Hill, Van Santen, Steadman, Chiara & Simpson

[57] ABSTRACT

A lofted golfing iron has the head or blade thereof provided with an integral rearwardly extending top flange or ledge increasing in width from the toe to the heel of the blade or head and defining a sighting rear edge line parallel with the bottom edge of the striking face of the blade or head so that the golfer can easily align the club normal to the intended direction of flight of the ball. The blade or head is connected to the shaft by a hosel projecting rearwardly from the back face of the blade or head at the heel thereof and then inclined away from the blade or head and extending forwardly and upwardly to position the shaft ahead of the top of the striking face of the blade or head thereby exerting a pushing force which decreases the lever arm tending to twist the club upon impacting the ball.

3 Claims, 7 Drawing Figures

GOLF CLUB

FIELD OF THE INVENTION

This invention relates to golf clubs and particularly golfing irons with a lofted blade having a sighting line on the top thereof which parallels the bottom edge of the striking face so that the golfer can easily align the blade at right angles to the intended flight of the ball. Specifically the invention deals with the provision of a rearwardly extending flange or ledge on the top edge of a lofted blade of a golfing iron which increases in width from the toe to the heel of the blade providing a rear edge sighting line which is parallel to the bottom edge of the striking face of the blade.

THE PRIOR ART

Heretofore the blades or heads of lofted golfing irons had top edges at an angle to the front edge of the sole or bottom edge of the striking face of the blade making it difficult for the golfer to align the blade to produce the desired flight path in striking the ball especially when the sole of the club is obscured by the turf when addressing the ball. Thus the golfer attempting to line up the club for the intended flight path of the ball is confused by a view of the blade which is at an angle to the flight path. In addition, conventional golfing irons have hosels projecting laterally from the heel end of the blade providing a lever between the striking face and the shank of the club which tends to twist the club upon impact causing shanking.

SUMMARY OF THIS INVENTION

This invention provides a sighting line for the blades or heads of lofted golfing irons and a hosel connection between the blade or head and the shaft of the club which will facilitate correct alignment of the club in addressing the ball and minimize turning of the blade upon impacting the ball. According to this invention the blade or head of the golfing iron which normally has a top edge at an angle to the bottom edge of the striking face or front edge of the sole of the club is provided with a flange or ledge projecting rearwardly from the top edge of the blade and extending substantially along the entire length thereof and increasing in width from the toe to the heel to define a rear sighting edge which is parallel with the bottom front edge of the blade. This sighting edge permits the golfer to align the striking face of the blade normal to the intended flight path of the ball even when the bottom edge of the blade is obscured by the turf. In addition the blade is connected to the shaft of the club by a hosel extending rearwardly from the rear face of the blade at the heel end thereof and integrated with the wide end of the ledge or flange and then inclined away from the heel and forwardly and upwardly to position the bottom end of the club shaft forwardly of the upper end of the blade to minimize the lever arm or torque arm tending to twist the blade upon impacting the ball.

The forward mounting for the shaft positions the shaft axis in a plane which passes through the central portion or "sweet spot" of the blade for delivering more energy of the swing to the ball.

It is then an object of this invention to provide a lofted golfing iron with a blade having a sighting edge parallel with the bottom edge of the striking face.

Another object of this invention is to provide a lofted golfing iron with a blade having a ledge extending rearwardly from the top edge thereof and increasing in width from the toe to the heel to define a rear edge parallel with the bottom edge of the front of the club.

Another object of this invention is to provide a lofted golfing iron with a top sighting edge parallel with the bottom edge of the striking face and a hosel connection to the club shaft which extends from the rear face of the heel end of the blade and thence forwardly and upwardly to align the shaft axis in a plane passing through the longitudinal central portion of the blade.

A specific object of the invention is to provide a golfing iron with a blade having a rearwardly extended flange along the top edge thereof increasing in width from the toe to the heel ends of the blade and integrated with a hosel extending rearwardly from the rear face of the blade at the heel and thence upwardly and forwardly to position the shaft of the club in a plane ahead of the top edge of the blade.

Other and further objects of this invention will become apparent to those skilled in this art from the following detailed description of the annexed sheet of drawings which, by way of a preferred example, illustrates one embodiment of this invention.

ON THE DRAWINGS

AS SHOWN ON THE DRAWINGS

Figures 1, 2, 3, 4, 5, 6, 7:
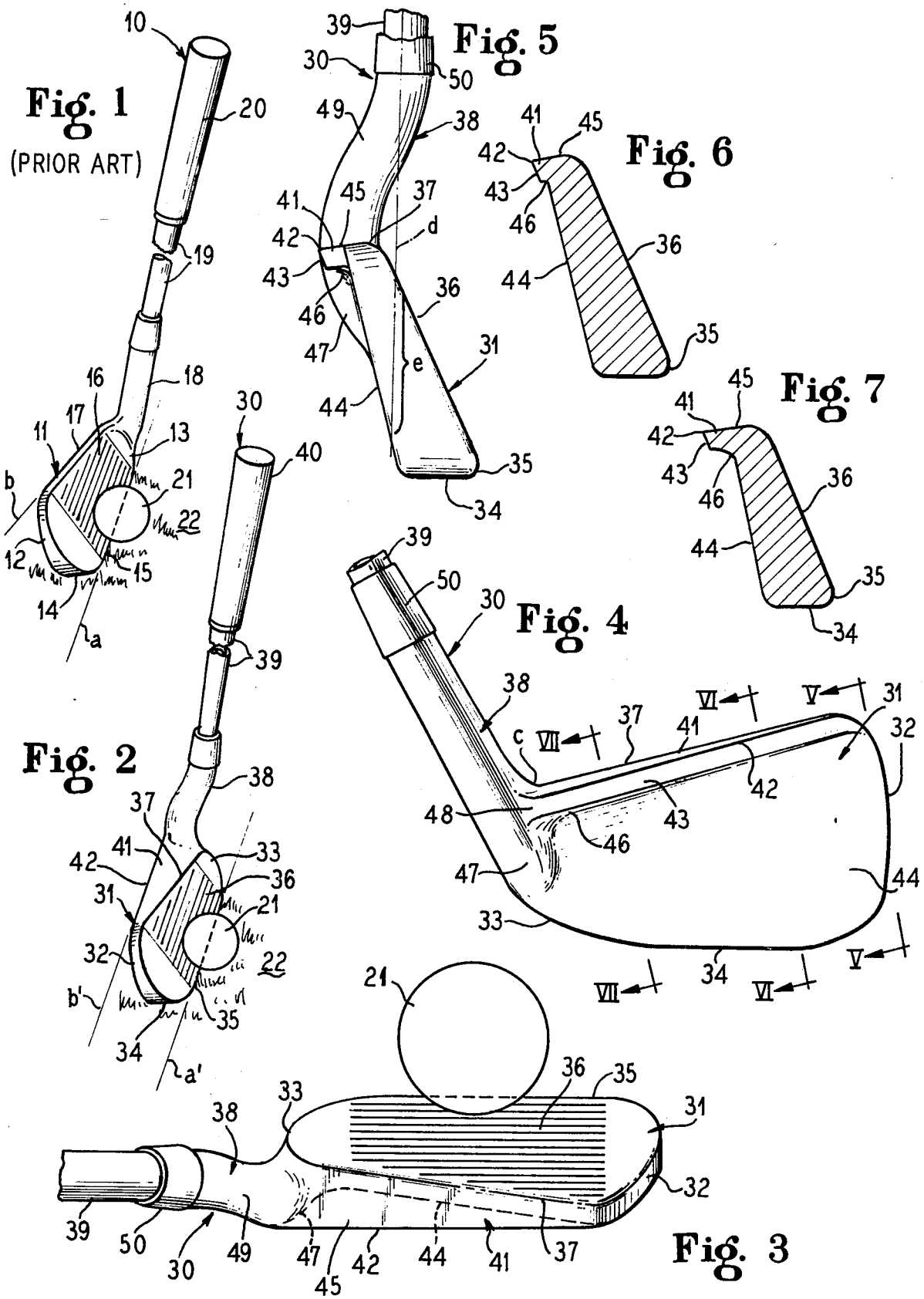
Fig. 1 (PRIOR ART)
FIG. 1 is a perspective view of a conventinal lofted golfing iron in position for addressing a ball in the turf normal to the intended flight path of the ball and showing the angular relationship between the sole or bottom edge of the striking face of the club and the top edge of the club.
FIG. 2 is a view similar to FIG. 1 but showing the club of this invention with the sighting line paralleling the sole or bottom edge of the striking face of the club.
FIG. 3 is a plan view of the golfing iron of this invention with the shaft broken away.
FIG. 4 is a rear elevational view of the golfing iron of this invention with the shaft broken away.
FIG. 5 is an end view of the golfing iron of this invention taken generally along the line V—V of FIG. 4 but showing the blade tilted with the heel end elevated.
FIG. 6 is a cross-sectional view along the line VI—VI of FIG 4.
FIG. 7 is a cross-sectional view along the line VII—VII of FIG. 4

The conventional golfing iron 10 of FIG. 1 has a blade 11 with a toe end 12 of greater height than the heel end 13, a thickened bottom sole portion 14 extending rearwardly from a front bottom edge 15 of the striking face 16 and a thinner top edge 17 extending from the toe to the heel. A hosel 18 extends laterally upwardly at an angle from the toe 13 to an inclined shaft 19 with a hand grip 20 on the top end thereof.

A ball 21 nestled in the turf 22 is addressed by the club 10 so that the blade 11 will have its striking face 16 normal to the intended flight path of the ball. In this ball addressing position, the bottom edge 15 of the blade must be parallel with a line "a" which is normal to the intended flight path of the ball and when in this proper addressed position relative to the ball, the top edge 17 of the blade will lie in a line "b" substantially diverging from the line "a". The golfer is thus confused in addressing the ball especially when the edge 15 is obscured by the turf 22 and cannot rely on the top edge 17 for proper guidance. The matter of properly positioning the striking face 16 at right angles to the intended flight of the ball is thus difficult and confusing. In addition the extension of the hosel from the toe end of the blade positions the shaft 19 so that the impact of the striking face 16 with the ball 21 will exert a twisting or turning action tending to shank the ball from its intended flight path.

By contrast the club 30 of this invention has a head or blade 31 which, like the blade 11 has a toe 32 of greater height than the heel 33, a flat sole 34 extending rearwardly from a front bottom edge 35 at the bottom of the striking face 36 which extends upwardly to a thinner top edge 37 but, unlike the club 10, has a different hosel 38 connecting the toe end 33 of the blade 31 to the shaft 39 which extends to the grip 40 and has a rearwardly extending flange 41 providing a rear top edge 42 parallel with the edge 35.

The ledge or flange 41, as best shown in FIG. 3, increases in width from the toe 32 to the heel 33 end of the blade and as shown in FIGS. 5–7 has a rear face 43 which is parallel with the back face 44 of the blade so that the top edge 42 provides an unobstructed sighting line from the toe to the heel end of the blade when the club is grounded on the sole 34 in addressing the ball 21. The ledge 41 has a top face 45 which is an extension of the top edge 37 of the blade and a bottom edge 46 which is curved to merge into the back face 44 of the blade.

The hosel 38 projects rearwardly at 47 from the back face 44 of the blade at the toe end 33 thereof and is merged or integrated into the wide end of the ledge 41 at 48 as shown in FIG. 4. The rearwardly projecting portion 47 of the hosel extends upwardly from the heel in inclined relation to the blade 31 providing an obtuse angle "c" with the top edge 37 of the blade. The hosel extends forwardly of this top edge 37 as illustrated at 49 in FIG. 5 and thence upwardly to provide a socket 50 receiving the lower end of the shaft 39.

As shown in FIG. 5, the shaft 39 is thus positioned so that its longitudinal axis "d" extends through the blade 31 intermediate the sole 34 and top edge 37 providing a "sweet spot" area "e" spaced from the sole 34 and top edge 37 for impacting the ball with the greatest force. This curved hosel 38 in being connected to the rear face 44 of the blade 31 instead of projecting laterally from the toe end 13 of the conventional blade 11 as shown in FIG. 1, and in curving forwardly to provide the shaft axis "d" provides a pushing action on the blade 31 with a minimum tendency for twisting the blade upon impacting the ball.

As shown in FIG. 2, the sighting line 42 provided by the ledge 41 is parallel with the front edge 35 and the lines a′ and b′, as contrasted with the lines a and b of FIG. 1 are thus parallel. The golfer, in aligning the edge 42 normal to the intended flight path of the ball 21 will thus properly address the ball even when the edge 35 is obscured by the turf 22.

From the above descriptions it will therefore be understood that this invention provides a golfing iron for a lofted iron club which has a sighting edge to facilitate proper addressing of the club to insure the desired flight path for the ball upon impact.

The invention also includes a hosel connection between the blade of the club and the shaft which minimizes the lever or torque arm tending to twist the club and which exerts a greater propelling force to the blade of the club.

I claim as my invention:

1. A lofted golfing iron which comprises a blade having a heel, a toe of greater height than the heel, a bottom sole having a front edge, an inclined striking face between the heel and the toe extending upwardly and rearwardly from the front edge of the sole, an inclined back face extending upwardly and rearwardly from the sole, a hosel extending rearwardly from the back face of the blade at the heel end thereof and thence curved upwardly and forwardly of the heel, a shaft secured to the upper end of the hosel, the axis of said shaft lying in a plane extending through the longitudinal mid-portion of the blade, and an integral ledge extending rearwardly from the back face of the blade along the top thereof and level with the top of the blade increasing in width from the toe to the heel and defining a rear sighting edge parallel with the front edge of the sole.

2. The golfing iron of claim 1 wherein the ledge has a rear face extending forwardly from the sighting edge which face is not visible to the golfer when addressing the ball.

3. The golfing iron of claim 2 wherein said rear face of the ledge is parallel to the back face of the blade.

* * * * *